US005360310A

United States Patent [19]

Jones et al.

[11] Patent Number: 5,360,310

[45] Date of Patent: Nov. 1, 1994

[54] CONTAINER HANDLING APPARATUS FOR A REFUSE COLLECTION VEHICLE

[75] Inventors: Rickie W. Jones, Plainview, Tex.; Gerald F. Martin, Raleigh, N.C.

[73] Assignee: Rand Automated Compaction System, Inc., Raleigh, N.C.

[21] Appl. No.: 40,665

[22] Filed: Mar. 31, 1993

Related U.S. Application Data

[60] Continuation of Ser. No. 843,433, Feb. 28, 1992, abandoned, which is a division of Ser. No. 429,199, Oct. 30, 1989, Pat. No. 5,092,731.

[51] Int. Cl.[5] ..... B65F 3/06

[52] U.S. Cl. ..... 414/409; 414/753; 414/422; 414/917; 254/122

[58] Field of Search ..... 414/408, 409, 403, 404, 414/406, 407, 628, 629, 419, 420, 630, 631, 421, 422, 917, 424, 423, 753, 546, p555, 540, 541, 542, 751; 187/9 R; 254/122

[56] References Cited

U.S. PATENT DOCUMENTS

| | | | |
|---|---|---|---|
| 3,165,348 | 1/1965 | Keskitalo | 294/106 |
| 3,177,029 | 4/1965 | Larson | 294/106 |
| 3,841,508 | 10/1974 | Ebeling et al. . | |
| 3,910,434 | 10/1975 | Ebeling et al. | 414/608 |
| 3,944,092 | 3/1976 | Ebeling et al. . | |
| 4,023,848 | 5/1977 | Bennett | 294/106 |
| 4,090,626 | 5/1978 | Ebeling et al. . | |
| 4,219,298 | 8/1980 | Stragier et al. | 414/409 |
| 4,227,849 | 10/1980 | Worthington | 414/555 |
| 4,313,707 | 2/1982 | Bingman et al. | 414/409 |
| 4,367,891 | 1/1983 | Wauer et al. | 294/88 |
| 4,401,407 | 8/1983 | Breckenridge | 294/106 |
| 4,427,333 | 1/1984 | Ebeling | 414/409 |
| 4,461,607 | 7/1984 | Smith | 294/106 |
| 4,543,028 | 9/1985 | Bell et al. | 414/555 |
| 4,669,940 | 6/1987 | Englehardt et al. | 294/106 |
| 4,708,570 | 11/1987 | Smith et al. | 294/106 |
| 4,726,726 | 2/1988 | Dossena et al. | 414/404 |
| 4,810,019 | 3/1989 | Brucher | 294/106 |
| 5,092,731 | 3/1992 | Jones et al. | 414/406 |

FOREIGN PATENT DOCUMENTS

| | | |
|---|---|---|
| 2168316 | 6/1986 | United Kingdom . |
| 550280 | 4/1977 | U.S.S.R. . |

OTHER PUBLICATIONS

Crane Carrier Company, "Integrated Front Loader" advetising brochure (no date).

Heil, "Automated Side Loader" advetising brochure (no date).

Frink Canada, "Autopower Recycler" advertising brochure (no date).

Holden, "Flexi-Dump" advertising brochure (no date).

Pak-Mor, "Container-Retriever" advertising brochure (no date).

Sunbelt Automated Systems, Inc., "Side Winder" advertising brochure (no date).

Tri-State Truck Equipment, "Rogers Recycler" advertising brochure (no date).

*Primary Examiner*—Frank E. Werner

*Attorney, Agent, or Firm*—Harris, Tucker & Hardin

[57] ABSTRACT

A mechanized container handling system on a motorized refuse collection vehicle includes a horizontally extensible and retractable support structure having an outer end on which a container grasping assembly is carried, and a container elevating and dumping assembly for lifting the grasped container and dumping its contents into an elevated hopper opening of the vehicle. The support structure comprises telescoped inner, intermediate and outer sections interconnected by an extension scissors structure, the intermediate section being horizontally driven by a hydraulic actuator and the scissors structure being operative to responsively extend and retract the outer section. The container elevating and dumping system is driven by a hydraulic piston and gear system positioned between the upper ends of a pair of support tracks and drivingly connected to a pair of articulated container lifting force arms. The container grasping assembly includes a pair of hydraulically pivotable articulated engagement arms having a spaced series of resilient container gripping members secured to inner side surfaces thereof, for liftingly engaging cylindrical refuse containers, and suitable engagement structure may be added for handling larger rectangular containers. The power and control portions of the hydraulic system used to operate the apparatus may be conveniently housed in a lift-off module detachably secured to the refuse collection vehicle.

11 Claims, 5 Drawing Sheets

CONTAINER HANDLING APPARATUS FOR A REFUSE COLLECTION VEHICLE

This application is a continuation, of application Ser. No. 07/843,433, filed Feb. 28, 1992, now abandoned, which is a divisional of application Ser. No. 07/429,199, filed Oct. 30, 1989, now U.S. Pat. No. 5,092,731.

BACKGROUND OF THE INVENTION

The present invention relates generally to mechanized container handling apparatus operatively mounted on over-the-road refuse collection vehicles, and more particularly relates to improvements in a mechanized refuse container handling system of the general type in which a container grasping structure is horizontally extended outwardly away from the vehicle, engages a refuse container, lifts the container and dumps its contents into the hopper portion of the vehicle, lowers the emptied container back to its original position, and then releases the container.

Mechanized container handling systems of this general type are known in the refuse handling art, and an example of such a system is illustrated in U.S. Pat. No. 4,669,940 to Englehardt et al. While mechanized refuse container handling systems of the type described provide valuable time and labor savings, and generally provide satisfactory operation, they have heretofore had a number of problems, limitations and disadvantages, of which the following are but a few.

For example, the horizontal reach limitation of the systems typically require that the associated collection vehicle be positioned fairly close to the container, and most systems cannot reach past an end of a car or truck parked at the curb adjacent the refuse container. Additionally, conventional container handling systems are not typically adapted to selectively handle both cylindrical, relatively small refuse containers and much larger, usually rectangular metal containers. As a result, these systems must usually make a first "run" to pick up one type container, and then be modified to make a second run to pick up the other type of container. Also, the pivoted engagement arms used to liftingly engage the cylindrically configured containers contact and grip such containers at only a few widely spaced points around their peripheries, and do not fold back into an essentially straightline position. The operating mechanisms for the container lifting and dumping portion of these systems tend to be fairly complex, large and somewhat difficult and expensive to assemble and dismantle.

In view of the foregoing, it is accordingly an object of the present invention to provide improved refuse container handling apparatus which eliminates or minimizes the above-mentioned and other problems, limitations and disadvantages typically associated with conventional container handling systems of the general type described.

SUMMARY OF THE INVENTION

Various aspects of the present invention, by themselves and in combinations with one another and with a refuse collection vehicle, may be utilized to provide improved refuse container handling apparatus of the type operative to lift a refuse container, dump its contents into a hopper portion of the vehicle, and then return the emptied container to its original resting place. Set forth below are brief summaries of various features of the present invention. The sole purpose of the following summarization is to provide a general overview of the present invention, and is not to be construed as in any manner limiting its nature or scope.

According to one aspect of the invention, the horizontal reach of the container handling apparatus is substantially increased using a container grasping assembly support structure having three interfitted sections—an inner section anchored to the vehicle, and intermediate section horizontally extensible and retractable relative to the inner section, and an outer section horizontally extensible and retractable relative to the intermediate section and having an outer end operative to horizontally move the container grasping assembly. The intermediate section is horizontally driven relative to the inner section, and means are provided for extending and retracting the outer section relative to the intermediate section in response to driven horizontal movement of the intermediate section. The extended reach capability provided by this structure permits the container grasping assembly to be moved past an end of a parked car or the like, if necessary to grasp a container.

According to another aspect of the invention, a pair of articulated container engagement arms are supported for pivotal movement between an open position, in which the arms are essentially straightened and positioned snugly against the vehicle generally within its width clearance profile, and a closed position in which the arms are outwardly pivoted and positioned to extend around a container and grasp it at a series of points extending around a major portion of an essentially circular path. Drivable linkage means are provided to pivot the articulated engagement arms between their open and closed positions. The linkage means are operative in a manner such that the engagement arms, in their closed position, are operative to uniformly grasp cylindrical containers of differing diameters at circumferentially spaced points around their circular peripheries.

According to a further aspect of the invention, horizontally spaced guide means, preferably in the form of vertical mast members, are provided along which container grasping means may be moved to lift, dump and lower a refuse container operatively engaged by the container grasping means. Drive means are provided for moving the container grasping means along the guide means, the drive means being positioned between the guide means and preferably including a fluid drivable actuator gear-connected to articulated force arms rotationally drivable to lift and lower the container grasping means along the guide means. Guide tracks are preferably formed in the outboard sides of the guide means, thereby permitting easy cross-bracing of the guide means.

According to yet a further aspect of the invention, a container grasping assembly is provided for selectively engaging either a generally cylindrical container or a larger, generally rectangular container so that the collection vehicle can handle both types of container in a single pickup run. The dual container grasping assembly preferably includes a linkage-driven pair of articulated container engagement arms, as described above, for engaging the smaller cylindrical containers, and a pair of supplemental container engagement means positioned outwardly of the opposite ends of the engagement arms in their closed, straightened position and operative to engage the larger rectangular containers.

According to a still further aspect of the invention, the various assemblies of a refuse container handling system are hydraulically driven, and the necessary hydraulic pumps, valves, controls and the like are contained in a modular power pack structure which may be easily removed from the collection vehicle for repair and maintenance purposes. The module may be rapidly connected to and disconnected from the various hydraulic lines of the system by means of quick disconnect fittings operatively secured to the module.

In addition to their individual advantages, when operatively combined with a suitable refuse collection vehicle the above-described features of the present invention provide an overall refuse collection system which is markedly superior to conventional systems of the general type described.

These and other aspects of the present invention are illustrated in the accompanying drawings and are subsequently described in greater detail herein.

DETAILED DESCRIPTION

Figure 1:
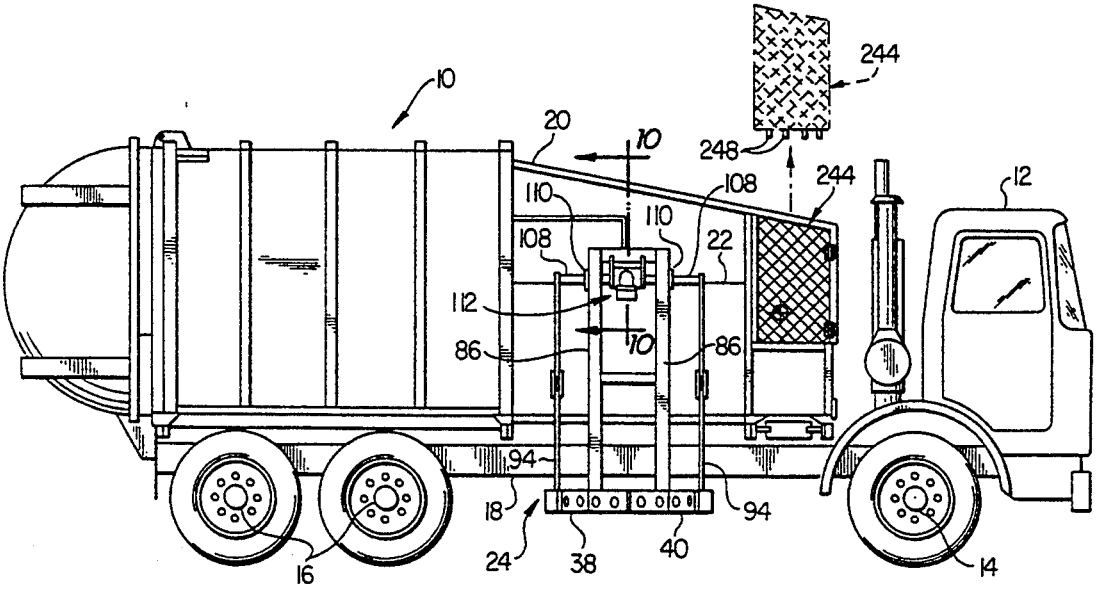
FIG. 1 is a side elevational view of a refuse collection vehicle on which container handling apparatus embodying principles of the present invention is operatively mounted.

Illustrated in FIG. 1 is a motorized refuse collection vehicle in the form of an over-the-road motor truck 10 having an operator's cab 12, and a conventional front steering wheel and axle assembly 14 and tandem rear drive axle and wheel assemblies 16 supporting a frame 18. The frame 18 supports a refuse collection hopper 20 which may include a suitable compaction mechanism (not illustrated). The hopper 20 includes an opening 22 formed in a side wall portion of the hopper for receiving refuse. The truck 10 is of a type typically used for collection of refuse from residential and commercial areas wherein individual containers are set out at the street curb, and adjacent alleyways or driveways for collection. The containers are typically cylindrical, open-topped metal or plastic cans.

Operatively supported on the truck 10 in a manner subsequently described is an improved container handling apparatus 24 which embodies principles of the present invention. Apparatus 24 is mounted on a container elevating and dumping mechanism 26 (see also FIG. 3) that is secured to the outer end of a horizontally extensible and retractable support structure 28 supported by the truck frame 18. In a manner subsequently described, the support structure 28 is operable to move the container and elevating dumping mechanism 26 horizontally between its extended position illustrated in FIG. 3, and its retracted position illustrated in FIG. 5.

Figure 2:
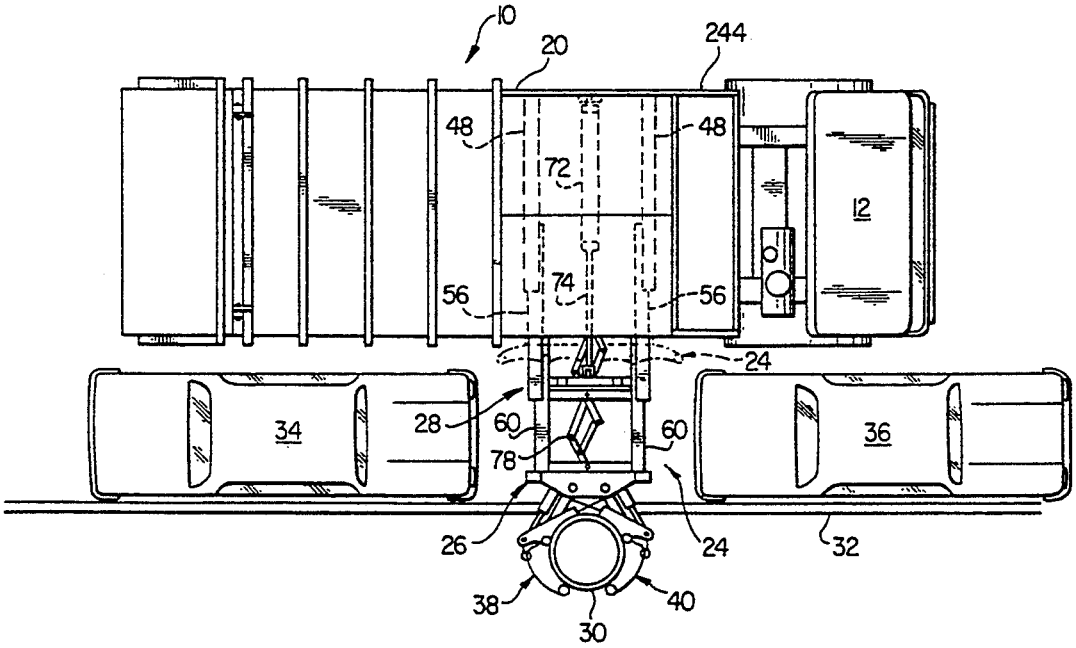
FIG. 2 is a top plan view of the refuse collection vehicle illustrating the greatly improved horizontal reach capabilities of the container handling apparatus.

Representatively illustrated in FIG. 2 is a cylindrical refuse container 30 set out at a curb 32 generally between a representative pair of cars 34 and 36 parked alongside the curb. To empty the contents of the container 30 into the truck hopper opening 22, the refuse collection truck 10 is pulled outwardly alongside the parked cars 34 and 36 and, in a manner subsequently described, the support structure 28 is moved to its extended position, causing the outer end of the support structure to pass horizontally through the space between the parked cars. After extension of the support structure 28, a pair of articulated container engagement arm structures 38 and 40, positioned at the lower end of the container elevating and dumping assembly 26, are graspingly closed around the container 30. At this point in time, the container elevating and dumping assembly 26, and the extensible support structure 28, are in their orientations depicted in FIG. 3.

Figure 5:
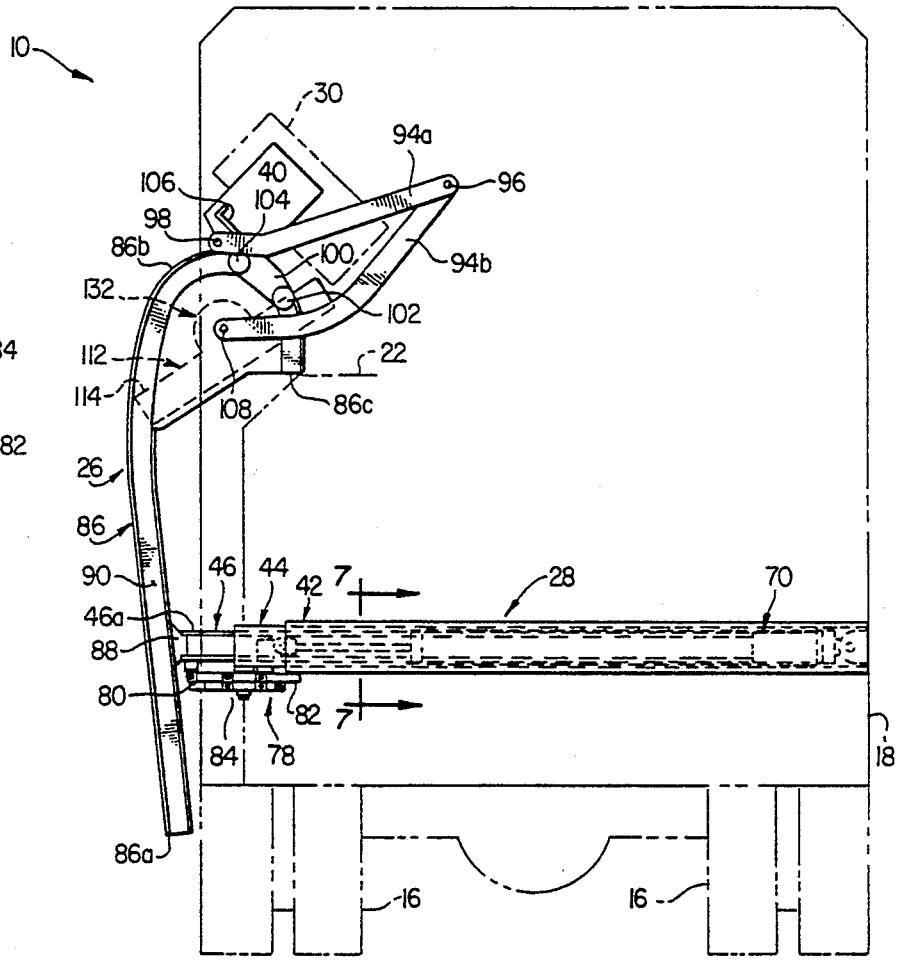
FIG. 5 is an enlarged scale side elevational view of the container handling apparatus in a raised, horizontally retracted position thereof.

Next, as subsequently described in greater detail, the support structure 28 is retracted to its orientation shown in FIG. 5, to horizontally move the container 30 to adjacent a lower side portion of the truck 10, and the elevating and dumping assembly 26 is operated to lift the container 30 to above the hopper opening 22, and tilt the container 30 in a clockwise direction to dump its contents into the hopper opening 22 as illustrated in FIG. 5.

Figure 3:
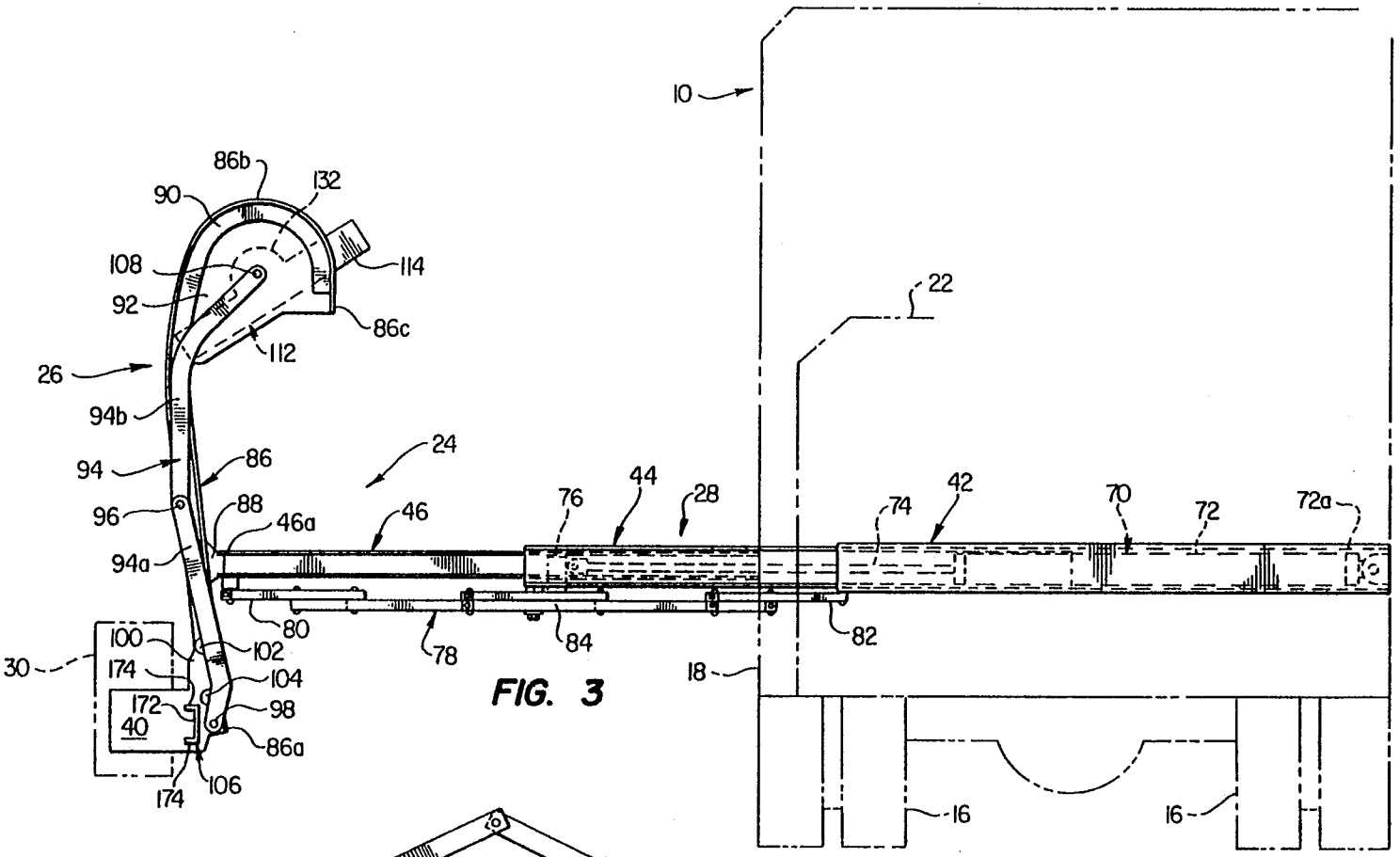
FIG. 3 is an enlarged scale side elevational view of the container handling apparatus in a lowered, horizontally extended position thereof.

The elevating and dumping assembly 26 is then operated to lower the now empty container 30 to ground level, and the support structure 28 is extended to return the container handling apparatus 24 to its FIG. 3 orientation in which the container is returned to its curbside resting place.

Finally, the container engagement arms 38, 40 are opened to release the container, and the support structure 28 is again retracted to horizontally inwardly move the elevating and dumping assembly 26 to a position closely adjacent the side of the truck 10 facing the cars 34, 36. When this final step is accomplished, and the container handling apparatus 24 is returned to the side of the truck, the apparatus is brought to within the normal clearance width profile of the truck as schematically indicated by the dotted line area 24 in FIG. 2.

At the outset, it should be noted that one of the various advantages provided by the improved container handling apparatus 24 of the present invention is its extended horizontal reach capabilities which permit it to grasp and handle the container 30 despite the fact that the refuse collection truck is precluded (by the parked cars 34, 36) from pulling directly alongside the curb 32. This extended horizontal reach capability of the container handling apparatus 24 arises through a unique construction and operation of the extensible and retractable support structure 28 which will now be described.

Figure 7:
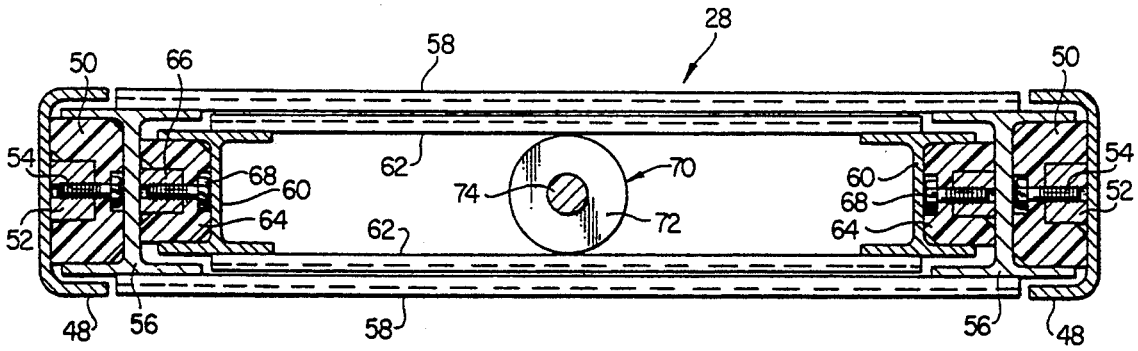
FIG. 7 is an enlarged scale cross-sectional view through a horizontally extensible and retractable support portion of the container handling apparatus taken along line 7—7 of FIG. 5.

Referring initially to FIGS. 3 and 7, the extensible and retractable support structure 28 includes a horizontally inner section 42 suitably anchored to the truck frame 18, a horizontally intermediate section 44, and a horizontally outer section 46 having an outer end portion $46_a$ to which a lower end portion of the container elevating and dumping assembly 26 is fixedly secured.

As best illustrated in FIG. 7, the horizontally inner section 42 of the support structure 28 includes a spaced pair of elongated channel members 48 suitable anchored to the truck frame 18 and having U-shaped cross-sections. A pair of elongated slide block members 50 are anchored to the facing side surfaces of the channel members 48 by means of mounting rails 52 and retaining bolts 54.

The horizontally intermediate section 44 of the support structure 28 includes a pair of I-beams 56 slidably carried by the mounting rails 50, as illustrated, and interconnected by transverse channel members 58 welded at their opposite ends to the upper and lower flanges of the I-beams 56. The mounting of the I-beams 56 on the slide blocks 50 permits the intermediate support structure section 44 to move horizontally inwardly and outwardly relative to the stationary inner support structure section 42.

The horizontally outer section 46 of the support structure 28 includes a vertically shorter pair of elongated H-beams 60 positioned laterally inwardly of the I-beams 56 and interconnected by transverse channel members 62 welded at their opposite ends to the top flanges of the H-beams 60. H-beams 60 are slidably mounted on elongated slide block members 64 secured to the vertical webs of the I-beams by mounting rails 66 and retaining bolts 68. Accordingly, the outer support structure section 46 is slidable into and out of the intermediate support structure section 44 which, in turn, is slidable into and out of the inner support structure section 42.

The support structure 28 is horizontally drivable between its FIG. 3 extended position and its FIG. 5 retracted position by a hydraulic cylinder actuator 70 positioned horizontally centrally within the support structure 28 and having a cylinder portion 72 anchored at its rear end $72_a$ to the truck frame 18 adjacent the right side of the truck as viewed in FIGS. 3 and 5, and an actuating rod portion 74. The outer or left end of the actuating rod 74 is anchored to the intermediate support structure section 44 by a connection block 76 anchored to a longitudinally intermediate portion thereof.

Figure 4:
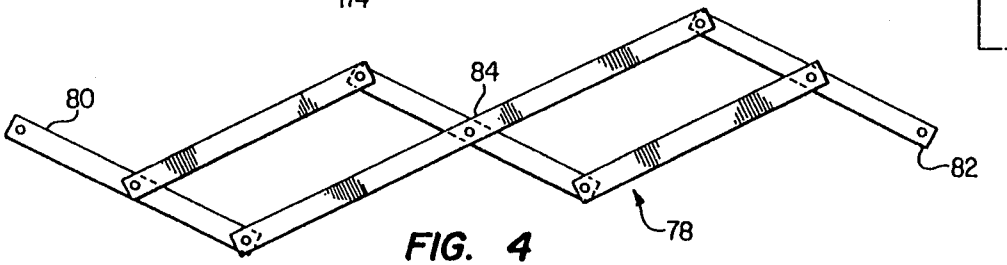
FIG. 4 is a bottom plan view of an extension scissors structure operatively connected to the container handling apparatus and illustrated in FIG. 3.
Figure 6:
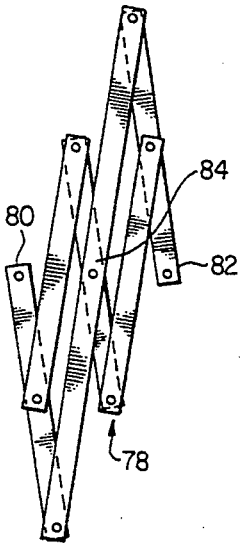
FIG. 6 is a bottom plan view of the extension scissors structure is its FIG. 5 position.

It can be seen by comparing FIGS. 3 and 5 that a hydraulically forced extension of the actuating rod 47 drives the intermediate support structure section 44 outwardly from within the inner support structure section 42, while hydraulic retraction of the actuating rod 74 draws the intermediate section 44 back into the inner section 42. A corresponding outward and inward horizontal movement of the outer section 46 relative to the intermediate section 44 into which it telescopes is achieved by linkage means in the form of an extension scissors structure 78 positioned below the support structure 28 (see FIGS. 4 and 6) and having an outer end 80 anchored to the outer end $46_a$ of the outer support structure section 46, an inner end 82 anchored to the inner support structure section 42 adjacent its outer end, and a central portion 84 anchored to the outer end of the intermediate support structure section 44.

The scissors structure 78 operates to extend the outer support structure section 46 relative to the intermediate support structure section 44 in response to driven extension of the intermediate section 44, and to retract the outer section 46 into the intermediate section 44 in response to drive retraction of the intermediate section 44 into the inner support section 42. Scissors structure 78 also functions to equalize the extension and retraction distances of the sections 44 and 46 relative to the support structure section into which they are telescoped. In this manner, the significantly increased horizontal reach of the container handling apparatus 24 previously discussed in conjunction with FIG. 2 is achieved.

Turning now to FIGS. 1, 3, 5 and 10, the structure and operation of the container elevating and dumping assembly 26, which is horizontally moved inwardly and outwardly from the side of the truck 10 by the previously described extensible and retractable support structure 28, will now be described. The assembly 26 includes a horizontally spaced pair of mast members 86 having lower ends $86_a$ and rearwardly and downwardly curved upper end portions $86_b$. Lower portions of the mast members 86, above their lower ends $86_a$, are anchored to a horizontally extending support member 88 which, in turn, is rigidly secured to the outer end $46_a$ of the outer support structure section 46. For purposes later described, laterally outwardly facing guide tracks 90 are formed in the mast members 86 and extend from the bottom end $86_a$ of each mast member to its downwardly facing upper end $86_c$. As viewed in FIG. 1, the guide track 90 in the left mast member 86 is formed along its left side, and the guide track 90 in the right mast member 86 is formed along its right side surface. For purposes later described, support plate members 92 are extended across and anchored to the curved upper portions $86_b$ of the mast members 86.

The container elevating and dumping assembly 26 also includes a pair of elongated, articulated force arm members 94 positioned outboard of the mast members 86 as best illustrated in FIG. 1. Each of the force arms 94 has, as viewed in FIG. 3, an elongated lower segment $94_a$ and an elongated upper segment $94_b$, the inner ends of each associated pair of arm segments being pivotly interconnected as at 96. The outer or lower ends of the arm segments $94_a$ are pivotly connected, as at 98, to a pair of support ear structures 100 positioned between each of the force arm segments $94_a$ and its associated mast member 86. Each of the support ear structures 100 has a pair of roller elements 102, 104 secured thereto and captively retained in the guide track 90 of their associated mast member 86 for rolling movement along the track between the opposite end portions of the mast member.

The support ear portions 100 are suitably anchored to longitudinally spaced apart portions of a horizontally disposed elongated mounting channel member 106 having a generally U-shaped cross-section. In a manner subsequently described, the container engagement arm structures 38, 40 are operatively connected to the mounting channel member 106.

As viewed in FIG. 3, the upper or outer ends of the force arm segments $94_b$ are fixedly secured to a pair of drive shafts 108 which extend inwardly through suitable openings formed in the support plate members 92, and are rotationally supported on the plate members by bearing structures 110 externally mounted on the plates 92. In a manner subsequently described, inner end portions of the shafts 108 are drivably secured to a hydraulically powered rotary actuator 112 which is suitably mounted between the support plate members 92 at the upper ends of the mast members 86.

Figure 10:
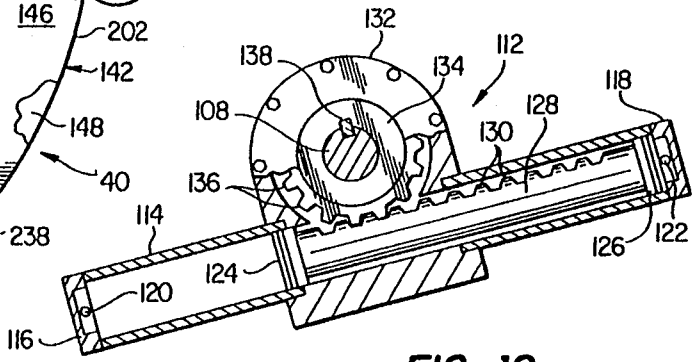
FIG. 10 is an enlarged, partially elevational cross-sectional view through a lifting/lowering drive portion of the container handling apparatus taken along line 10—10 of FIG. 1.

As best illustrated in FIG. 10, the rotary actuator 112 comprises an elongated cylinder 114 having closed opposite ends 116, 118 through which hydraulic fluid inlet ports 120, 122 are formed. A longitudinally spaced pair of piston structures 124 and 126 are reciprocatively mounted within the cylinder 12 and are anchored to the opposite ends of a rack member 128 having, along its length, a series of upwardly facing teeth 130.

A generally cylindrical housing 132 projects upwardly from a longitudinally central portion of the cylinder 112 and rotatably supports therein an annular pinon gear 134 having peripheral teeth 136 operatively meshed with the rack teeth 130. The inner ends of the drive shafts 108 are received within the central opening of the annular pinon gear 134 and are rotationally locked thereto by key members 138.

Referring now to FIGS. 3, 5 and 10, after the support structure 28 has been horizontally inwardly moved from its FIG. 3 extended position to its FIG. 5 retracted position, the refuse container 30 (which is gripped by the container engagement arm structures 38, 40) is raised from its lowered FIG. 3 position to its FIG. 5 dumping position by forcing hydraulic fluid from a source thereof into the inlet port 122 to leftwardly drive the pistons 124, 126 and the rack member 128 through the interior of the cylinder 112. Such leftward movement of the rack member 128 rotates the pinon gear 134, and thus the drive shafts 108, in a clockwise direction as viewed in FIG. 10. The clockwise driven rotation of the shafts 108 pivots the upper force arm segments $94_b$ in a clockwise direction away from their FIG. 3 positions to their FIG. 5 positions. Clockwise rotation of the upper force arms segments $94_b$ lefts the lower force arm segments $94_a$ while causing them to pivot in a counterclockwise direction relative to the upper force arm segments $94_b$ and move the force arm segments $94_a$ to their FIG. 5 position.

The upward movement of the force arm segments $94_a$, in turn, lifts the support ear structures 100 (and thus the container engagement arms 38, 40 and the gripped container 30) and moves the roller elements 102, 104 upwardly along the guide tracks 90 to ultimately move the container 30 to the upper end portions $86_b$ of the mast members 86 and tilt the container 30 to its refuse dumping orientation illustrated in FIG. 5.

To lower the now emptied container 30 to its FIG. 3 position adjacent the bottom ends $86_a$ of the mast members 86, hydraulic fluid is simply forced into the inlet port 20 at the left end of the cylinder 112 (FIG. 10) to return the rack member 128 rightwardly through the cylinder 112 to cause a counter clockwise rotation of the pinon gear 134 and the drive shafts 108 to move the articulated force arms 94 from their FIG. 5 orientation back to their FIG. 3 orientation.

The use of the rotary actuator 112, and its inboard mounting between the support plates 92 coupled with the laterally exterior positioning the roller elements 102 and 104, provides the container elevating and dumping assembly 26 with an essentially unimpeded front side portion extending horizontally between the articulated force arms 94. Additionally, the use of the rotary actuator 112, together with its previously described inboard mounting position, substantially facilitates the installation of the drive portion of the elevating and dumping assembly 26.

Specifically, after the rotary actuator 112 has been suitably mounted between the support plate members 92 at the upper ends of the mast members 86, the drive shafts 108 may be simply inserted inwardly through the support plate openings and rotationally locked to the pinon gear 134. The bearing structure 110 (FIG. 1) may then be simply slid inwardly along the outer ends of the drive shaft members 108 and bolted to the exterior of the plates 92. Finally, the outer ends of the drive shafts 108 can then be fixedly secured to the outer ends of the force arm segments $94_b$.

Figure 8:
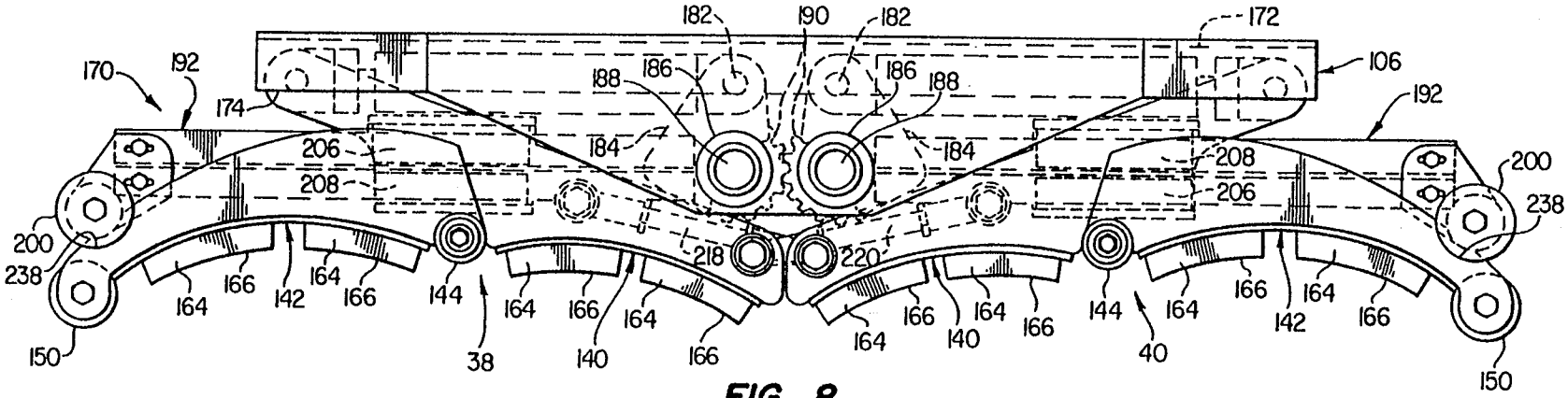
FIG. 8 is an enlarged scale top plan view of an articulated container engagement portion of the overall container handling apparatus, the container engagement portion being in its open position.
Figure 9A:
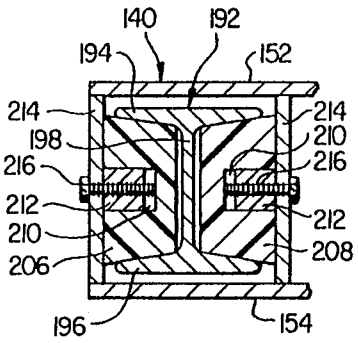
FIG. 9A is an enlarged cross-sectional view of the elongated I beam linking members and tapered slide block members which support the inner arm segments of the articulated container engagement arm structure.
Figure 9:
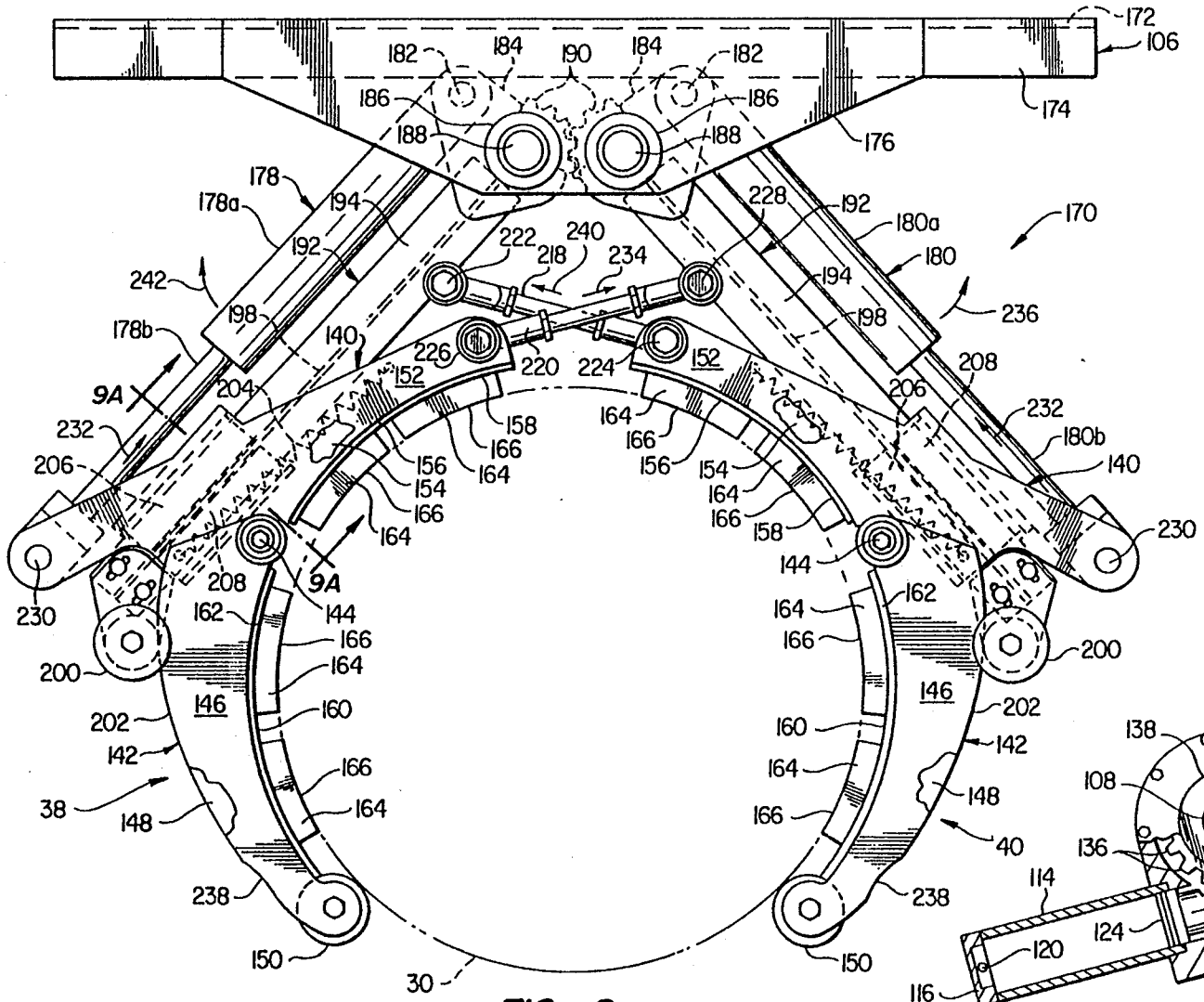
FIG. 9 is a view similar to that in FIG. 8 but with the container engagement portion in its closed position.

As best illustrated in FIGS. 8 and 9, each of the opposed container engagement arm structures 38, 40 is of an articulated construction comprising inner and outer segments 140 and 142, the inner ends of the outer arm segments 142 being pivotly connected to longitudinally intermediate portions of their associated inner arm segments 140 by pivot structures 144. The outer arm segments 142 are each defined by a vertically spaced pair of elongated, generally arcuate top and bottom plate members 146 and 148 which are secured at their outer ends to roller elements 150. The inner arm segments 140 are defined by a vertically spaced pair of elongated, generally straight top and bottom plate members 152 and 154.

The vertical distance between plates 146, 148 is slightly greater than the vertical distance between the plates 152, 154 so that, as illustrated, inner end portions of the plate pairs 146, 148 overlie and are slidable along portions of their associate plate pairs 152, 154. Inner side edges 156 of the plate pairs 152, 154 have a circularly arcuate configuration and have secured thereto similarly curved vertical plates 158. In a similar fashion, the plate pairs 146, 148 have inner side edges 160 having circularly arcuate configurations and a pair of circularly curved vertical plates 162 secured thereto. Radially inwardly projecting arcuate resilient gripping members 164, each having an arcuate inner side surface 166, are suitably secured in circumferentially spaced pairs to the curved vertical plates 158 and 162.

As may be seen by comparing FIGS. 8 and 9, the container engagement arm structures 38, 40 are movable between an open position (FIG. 8) and a closed position (FIG. 9). In their FIG. 8 open positions, the arm structures 38, 40 extend in opposite directions and assume generally straight elongated configurations so that the opened arms 38, 40 may be compactly positioned alongside the truck 10 as may be seen in FIG. 1. In their FIG. 9 closed position, the arms 38, 40 are pivoted to generally arcuate orientations in which the closed arms extend around a major circumferential portion of the refuse container 30 and the resilient members 164 are brought into gripping engagement with the refuse container. Importantly, as can be seen in FIG. 9, the interior side surfaces 166 of the gripping members 164, with the engagement arms in their closed positions, are disposed around an essentially circular arc portion so that a very uniform circumferential gripping area on the container 30 is advantageously achieved.

The container engagement arm structures 38, 80 are operatively secured to the elongated mounting channel member 106 (see also FIGS. 3 and 5) for movement between their illustrated open and closed positions by a unique, hydraulically actuated linkage system 170 which will now be described in detail with reference to FIGS. 8 and 9. The channel member 106 has a rearwardly disposed vertical base portion 172 from the top and bottom side edges of which upper and lower flanges 174 forwardly project. Secured to the flanges 174 and projecting forwardly therefrom, are a pair of upper and lower, generally trapezodally shaped mounting plates 176.

The linkage system 170 is driven by a pair of hydraulic cylinder actuators 178, 180 respectively associated with the left and right inner engagement arm segments 140. Actuator 178 has a cylinder portion $178_a$ and an actuating rod portion $178_b$, and actuator 180 has a cylinder portion $180_a$ and actuating rod portion $180_b$. The inner ends of the cylinders $178_a$, $180_a$ are positioned between the mounting plates 176 and are pivoted at points 182 to connection plate members 184 which are welded to hollow. cylindrical collar members 168 rotatably mounted on spaced apart pivot pins 188 anchored at their opposite ends to the mounting plates 176. For purposes later described, intermeshing gear teeth 190 are formed around the peripheries of the collars 186.

The linkage system 170 includes elongated I-beam linking members 192 which are positioned inboard of and extend parallel to the hydraulic cylinder actuators 178, 180 as can be best seen in FIG. 9A, each of the I-beams 192 having upper and lower flanges 194 and 196 interconnected by a vertical web portion 198. The inner ends of the I-beams 192 are welded to the connection plate members 184, and the outer ends of the I-beams 192 have roller structures 200 suitably anchored thereto and rollingly engaging the outer side surfaces 202 of the upper and lower plate portions 146, 148 of the outer container engagement arm segments 42. Outer arm segments 142 are pivotly biased into operative engagement with these roller structures 200 a pair of elongated tension coil spring elements 204 each connected at its opposite ends to an associated pair of bottom plate portions 148 and 154 of the container engagement arm structures 38 and 40.

For purposes later described, each of the I-beams 192 extends between one of the upper and lower plate pair portions 152, 154 of its associated inner arm segment 140 as illustrated in FIG. 9A. Each of the I-beams 192 is slidingly supported between its associated plate pair 152, 154 by a pair of elongated, tappered slide block members 106, 108 extending transversely into the I-beam 192 between its flanges 194 196 on opposite sides of its web 198. The slide blocks 102, 108 have generally rectangular slots 210 extending inwardly from their outer side surfaces, the slots 210 receiving a pair of elongated metal guide rail members 212 suitably anchored to opposed side plates 214 extending between and welded to the upper and lower arms segment plates 152, 154. To adjust the sliding contact between the side blocks 206 208 and the I-beams 192 which they slidably support, adjustment bolts 216 are threaded into tapped openings formed in the guide rails 212 and have inner ends which bear against the inner sides of the slots 210. The slide blocks 206, 208 may be forced into the opposite side cavities of the I-beam 192 by tightening the slots 216, and a looser engagement between the I-beam and the slide blocks may be achieved simply by loosening the bolts 216.

The inner ends of the inner engagement arm segments 140 are cross-connected to opposite I-beams 192 by means of a pair of length-adjustable turnbuckle structures 218 and 220. Specifically, the left end 222 of turnbuckle 218 is fixedly anchored to the left I-beam 192 adjacent its inner end, and the right end 224 of turnbuckle 218 is pivotally connected to the inner end of the right inner engagement arm segment 140. The left end 226 of turnbuckle 220 is pivotally connected to the inner end of the left inner engagement arm segment 140, and the right end 228 of turnbuckle 220 is fixedly anchored to the right I-beam 192 adjacent its inner end. As illustrated, the outer ends of the actuating rods $180_b$ are pivotally connected, at points 230 to the outer ends of their associated inner engagement arm segments 140.

To describe the unique operation of the hydraulically actuated linkage system 170, it will be assumed that the container engagement arm structures 38, 40 are in their fully closed position as depicted in FIG. 9. With the engagement arms 38, 40 in this position the actuating rods $178_b$, $180_b$ are fully extended, and the roller structures 200 on the outer ends of the I-beams 192 are longitudinally adjacent the outer ends of the inner engagement arm segments 140. Additionally, the hydraulic actuators 178, 180 are downwardly and horizontally outwardly sloped relative to the mounting channel 106 (as viewed in FIG. 9), and the slide block pairs 206, 208 carried by the inner arm segments 140 are positioned adjacent the outer ends of their associated I-beams 192.

To rearwardly pivot the container engagement arm structures 38, 40 from their FIG. 9 closed positions to their FIG. 8 open positions in which the arms 38, 40 are essentially straightened and positioned parallel to and adjacent the channel member 106, pressurized hydraulic fluid from a source thereof is forced into the cylinders $178_a$, $180_a$ to initiate retraction of the actuating rods $178_b$, $180_b$ as indicated by the directional arrows 232. Retraction of the left actuating rod $178_b$ exerts, via the left inner engagement arm section 140 and the turnbuckle 220, a generally rightwardly directed force 234 on the right I-beam 192 which initiates a counterclockwise pivoting 236 of the actuator 180, the right I-beam 192, and the right inner engagement arm segment 140 toward the mounting channel member 106. During this pivotal movement 236, the right slide block pair 206, 208 slides leftwardly and upwardly along the right I-beam 192 as viewed in FIG. 9. Also during this counterclockwise pivotal 236, the right outer engagement arm segment 142 is pivoted in a counter clockwise relative to the right inner engagement arm segment 140 due to the outward biasing force of the right spring elements 204, whereby the right outer engagement arm segment 142 is maintained in contact with the right roller structure 200 which rolls outwardly along the right side edges 202 toward detent indentations 238 formed therein adjacent their outer ends.

A similar movement of the left side of the illustrated linkage system 170 is achieved in response to retraction of the right actuating rod $180_b$. Specifically, upon such retraction of the right actuating rod $180_b$, a force 240 is generated, via the turnbuckle 218 and the right inner engagement arm section 140, which acts on the left I-beam 192 to pivot it in a clockwise direction as indicated by the arrow 242. Clockwise pivotal movement of the left I-beam 192 correspondingly pivots the left actuator 178 and the left engagement arm segments 140 and 142, the left outer arm segment 142 being maintained in contact with the left roller structure 200, by the left spring 204, as the left roller structure 200 rolls along the outer side edges 202 of the left arm segment 142 toward detent depressions 238 formed therein.

When both of the actuating rods 148$_b$ and 180$_b$ have been fully retracted as indicated in FIG. 8, the I-beams 192, the actuators 178 and 180, and the container engagement arms 38, 40 are brought to their open positions, are closely adjacent the channel member 106, and extend generally parallel to the channel member 106. The slide block pairs 206, 208 have been moved inwardly along their associated I-beams 192, and the roller structures 200 are received in their associated edge detent depressions 238 on the outer arms segments 142.

To move the container engagement arms 38, 40 from their FIG. 8 open positions to their FIG. 9 closed positions the actuating rods 178$_b$ and 180$_b$ are simply extended again which reverses the positional sequencing of the linkage system 170 just described.

The previously described adjustable slide block pairs 206, 208 advantageously function to add rigidity to the linkage system 170. Specifically, such slide block pairs function to inhibit undesirable horizontal tilting of the arms 38, 40 relative to the linkage system 170. The desirable stabilizing effect of the slide block pairs 206, 208 is maintained throughout the motion range of the engagement arm structures 38, 40 from their open positions to their closed positions. Pivotal synchronization of the left and right sides of the linkage system 170 is facilitated by the intermeshing gear teeth 190 on the collar members 186.

It will be readily appreciated that the linkage 170 just described advantageously employs, in a compact fashion, linear force inputs to cause the pivotal and straightening motions of the arms 38, 40 as they are moved from their open position to their closed position, and create a reverse pivotal and straightening motion of the engagement arms when they are moved from their closed position to their open position. While it is preferable that both of the actuators 178, 180 be used, it will be appreciated that, due to the unique cross-connection between the opposed linkage halves, one of the actuators could be eliminated if desired.

For purposes of illustrative clarity, various conventional hydraulic components, such as hydraulic lines, pumps, reservoirs and the like required to operate the previously described container handling apparatus 24 have been omitted from the drawings. According to a feature of the present invention, various key central components of the overall hydraulic system associated with the container handling apparatus 24, such as pumps, reservoirs, valves and the like are conveniently housed in a removable hydraulic module structure 244 (FIG. 1) detachably mounted on a top front portion of the refuse collection hopper 20 and supported on a suitable frame structure 246. The various flexible hydraulic lines used to power the container handling apparatus 24 may be conveniently connected to and removed from representative quick disconnect fittings 248 projecting outwardly from the module 244, thereby permitting the module, and the hydraulic equipment housed therein, to be easily separated from its hopper mounting structure and removed for repair and maintenance purposes. When these tasks are completed, the module 244 may be simply repositioned on its frame structure 246 and the hydraulic lines reconnected to the fittings 248.

Figure 11:
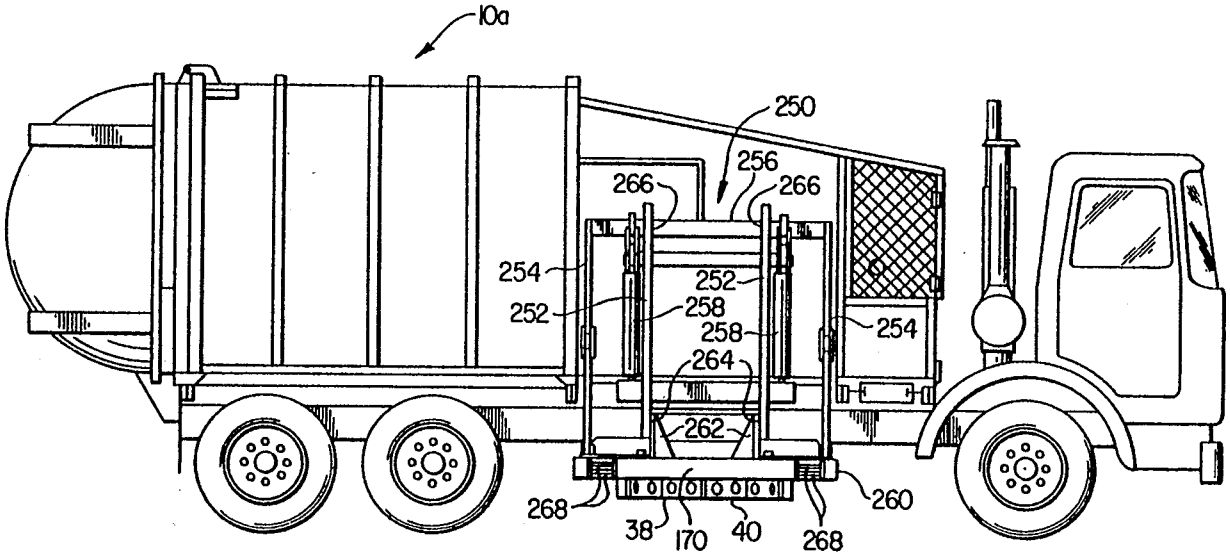
FIG. 11 is a side elevational view of a refuse collection vehicle incorporating improved container handling apparatus adapted for selective handling of either relatively small cylindrical refuse containers or much larger, generally rectangular metal refuse containers.

Illustrated in FIG. 11 is a refuse collection truck 10$_a$ similar to the truck 10 in FIGS. 1 and 2. Operatively mounted on the truck 10$_a$ is a container handling system 250 similar to that illustrated and described in U.S. Pat. No. 4,669,940 to Inglehardt et al, the apparatus 250 including a pair of vertical mast members 252 positioned inboard of a pair of articulated drive arms 254 connected at their upper ends to an elongated drive shaft 256 extending through upper ends of the mast members 252 and driven by hydraulic cylinder actuators 258 positioned between the masts 252 and the arms 254 as illustrated. The lower ends of arms 254 are secured to the opposite ends of a horizontal support member 260. A pair of support structures 262 are secured to the member 260 and have roller structures 264 captively retained in guide tracks 266 formed on the inner side surfaces of the masts 252. As more fully described in U.S. Pat. No. 4,669,940, operation of the actuators 258 causes the support member to be moved upwardly or downwardly along the masts 252.

Secured to opposite end portions of the support member 260 are horizontally extending pairs of metal pins 268 which may be engaged with the spaced latch hook structures on a typical relatively large retangular metal trash container, the system 250 being adapted to lift and rearwardly tilt the retangular container to empty its contents into the hopper portion of the truck 10$_a$.

In accordance with a further aspect of the present invention, the previously described container engagement arm structures 38 and 40, and the previously described drive linkage 170, are secured to the support member 260. This incorporation of the arms 38, 40 and the linkage system 170 into the container handling system 250 advantageously provides it with the ability to handle either cylindrical refuse containers or considerably larger retangular metal containers without having to adjust or otherwise modify the system to change it over from one type of container to the other.

The foregoing detailed description is to be clearly understood as being given by way of illustration and example only, the spirit and scope of the present invention being limited solely by the appended claims.

What is claimed is:

1. Extended reach support structure for supporting a refuse container grasping, elevating and dumping system portion of a refuse collection vehicle for selective inward and outward movement of the system in a first horizontal direction relative to the vehicle, said support structure comprising:

an inner section which can be anchored to a refuse collection vehicle above ground;

an intermediate section carried by said inner section for horizontal extension and retraction relative thereto in said first direction;

an outer section carried by said intermediate section for horizontal movement therewith and horizontal extension and retraction relative thereto, said outer section having an outer end portion which can be secured to the refuse container grasping, elevating and dumping system;

drive means for drivingly extending and retracting said intermediate section relative to said inner section; and linking means, connected to said inner, intermediate and outer sections, for extending and retracting said outer section relative to said intermediate section, in response to driven extension and retraction of said intermediate section relative to said inner section, respectively, a distance proportional to a horizontal distance and intermediate section is driven relative to said inner section by said drive means.

2. The extended reach support structure of claim 1 in combination with the refuse collection vehicle.

3. The support structure of claim 1 wherein:

said linking means include an extension scissors structure having a first end secured to said inner section, a second end secured to said outer section, and an intermediate portion positioned between said first and second ends and secured to said intermediate section.

4. The support structure of claim 1 wherein:

said distance that said outer section is moved relative to said intermediate section is substantially equal to the horizontal distance said intermediate section is driven relative to said inner section by said drive means.

5. The support structure of claim 1 wherein:

said inner, intermediate and outer sections of said support structure are telescopingly engaged, and said drive means are positioned generally within said inner section.

6. The support structure of claim 5 wherein:

said drive means include a hydraulically operable actuator having cylinder and actuating rod portions.

7. Extended reach support structure for supporting a refuse container grasping and handling system portion of an mechanized refuse collection vehicle for selective inward and outward movement of the system in a first horizontal direction relative to the vehicle, said support structure comprising:

a laterally spaced pair of elongated first support members which can be secured to the refuse collection vehicle and longitudinally extending across a width thereof, said first support members having horizontally facing side portions;

first slide elements anchored to said facing side portions of said first support elements;

a pair of elongated second support members slidingly carried by said first slide elements for horizontal longitudinal retraction into a space between said first support members, and horizontal longitudinal extension beyond said first support members, said second support members having horizontally facing side portions;

second slide elements anchored to said facing side portions of said second support members;

a pair of elongated third support members slidingly carried by said second slide elements for horizontal longitudinal retraction into a space between said second support members, and horizontal longitudinal extension beyond said second support members, said third support members having outer ends which can be supportingly anchored to a refuse container grasping and handling system;

drive means for drivingly extending and retracting said second support members relative to said first support members; and linking means, connected to said first, second and third support members, for extending and retracting said third support members relative to said second support members, in response to driven extension and retraction of said second support members relative to said first support members, respectively, a distance substantially equal to a horizontal distance said second support members are driven relative to said first support members by said drive means.

8. The extended reach support structure of claim 7 in combination with the refuse collection vehicle.

9. The support structure of claim 7 wherein:

said linking means include an extension scissors structure having a first end connected to said first support members, a second end connected to said third support members., and an intermediate portion positioned between said first and second ends and connected to said second support members.

10. The support structure of claim 9 wherein:

said extension scissors structure is positioned beneath said first, second.,and third support members.

11. The support structure of claim 10 wherein:

said drive means include a hydraulic cylinder and rod actuator positioned generally between said first support members.

* * * * *